US008333293B2

(12) United States Patent
Morand

(10) Patent No.: US 8,333,293 B2
(45) Date of Patent: Dec. 18, 2012

(54) WASTE DISPOSAL DEVICE

(75) Inventor: Michel Morand, Montréal (CA)

(73) Assignee: International Refills Company Limited (BB)

( * ) Notice: Subject to any disclaimer, the term of this patent is extended or adjusted under 35 U.S.C. 154(b) by 0 days.

(21) Appl. No.: 12/847,474

(22) Filed: Jul. 30, 2010

(65) Prior Publication Data

US 2011/0309082 A1 Dec. 22, 2011

Related U.S. Application Data

(60) Provisional application No. 61/230,203, filed on Jul. 31, 2009, provisional application No. 61/239,867, filed on Sep. 4, 2009, provisional application No. 61/311,490, filed on Mar. 8, 2010.

(51) Int. Cl.
*B65D 43/26* (2006.01)
*B65D 43/18* (2006.01)

(52) U.S. Cl. ..... 220/264; 220/263

(58) Field of Classification Search ..... 220/495.08, 220/495.06, 495.01, 326, 324, 315; D34/9, D34/8, 7; *B65D 43/26, 43/18, 51/18*
See application file for complete search history.

(56) References Cited

U.S. PATENT DOCUMENTS

| | | | | |
|---|---|---|---|---|
| 2,527,449 | A * | 10/1950 | Poole et al. | 220/264 |
| 5,125,526 | A * | 6/1992 | Sumanis | 220/263 |
| 5,655,680 | A | 8/1997 | Asbach et al. | |
| 5,758,819 | A | 6/1998 | Sniegocki | |
| 5,765,339 | A | 6/1998 | Garland | |
| 5,799,909 | A | 9/1998 | Ziegler | |
| 6,065,272 | A | 5/2000 | Lecomte | |
| 6,370,847 | B1 | 4/2002 | Jensen et al. | |
| 6,516,588 | B2 | 2/2003 | Jensen et al. | |
| 6,719,194 | B2 | 4/2004 | Richards | |
| 6,817,164 | B2 | 11/2004 | Mauffette et al. | |
| 6,941,733 | B2 | 9/2005 | Chomik et al. | |
| 6,974,029 | B2 | 12/2005 | Morand et al. | |

(Continued)

FOREIGN PATENT DOCUMENTS

WO 2008030997 3/2008

OTHER PUBLICATIONS

Int'l Search Report and Written Opinion for PCT/CA2010/001208, dated Nov. 12, 2010.

(Continued)

*Primary Examiner* — Mickey Yu
*Assistant Examiner* — Robert J Hicks
(74) *Attorney, Agent, or Firm* — Cantor Colburn LLP

(57) ABSTRACT

A waste disposal device comprises a container having a top opening. The container provides access to an inner cavity that receives a bag with opened and closed ends. A pivoting lid closes/opens access to the opening. An actuation mechanism has a user-actuated interface. A linkage connected to the interface opens/closes the lid. A pair of jaws is connected to the linkage. The jaws move between a clamped position, in which the jaws close off a portion of the bag, and an opened position, in which the jaws are separated to allow waste to reach the closed end. The jaws and the lid are actuated concurrently by a single degree of actuation on the interface, allowing the lid to open and close while the jaws move from the clamped to the opened position, and back to the clamped position. A method for disposal of a waste object is also provided.

19 Claims, 8 Drawing Sheets

U.S. PATENT DOCUMENTS

| | | | | |
|---|---|---|---|---|
| 6,994,247 | B2 | 2/2006 | Richards | |
| 7,178,314 | B2 | 2/2007 | Chomik et al. | |
| 7,406,814 | B2 | 8/2008 | Morand | |
| 2002/0066261 | A1 | 6/2002 | Richards | |
| 2002/0092273 | A1 | 7/2002 | Nygaard Jensen et al. | |
| 2004/0134914 | A1 | 7/2004 | Richards | |
| 2004/0194433 | A1 | 10/2004 | Chomik et al. | |
| 2005/0044819 | A1* | 3/2005 | Chomik et al. | 53/459 |
| 2006/0037289 | A1 | 2/2006 | Chomik et al. | |
| 2007/0125792 | A1 | 6/2007 | Pollack et al. | |
| 2009/0034886 | A1 | 2/2009 | Conforti | |
| 2009/0126320 | A1 | 5/2009 | Rousso et al. | |
| 2009/0127260 | A1 | 5/2009 | Rousso et al. | |

OTHER PUBLICATIONS

Dekor diaper disposal system, Internet, http://www.diaperdekor.com/diaperdekor.aspx Publication date: Jul. 20, 2009.

* cited by examiner

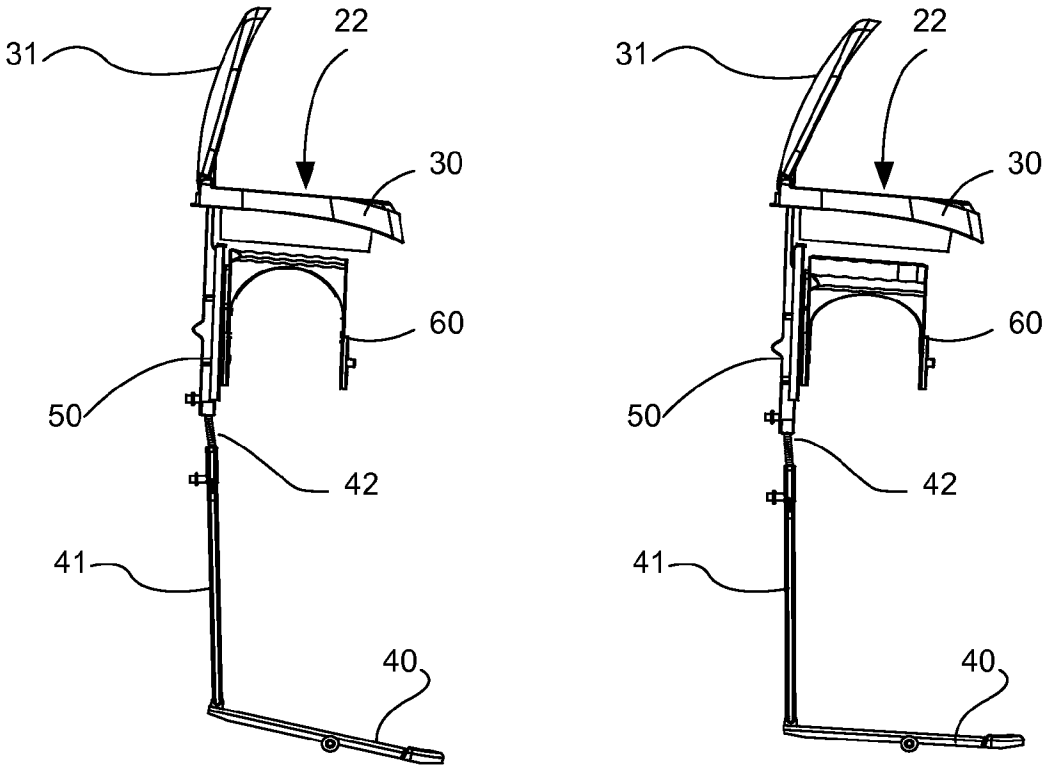
Fig. 3A
Fig. 3B
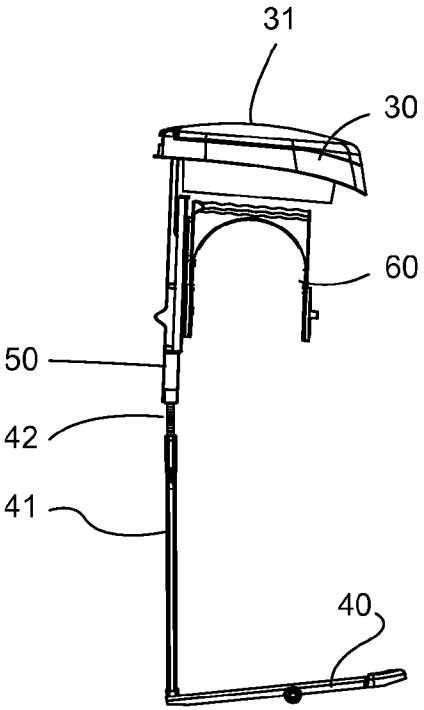
Fig. 3C

WASTE DISPOSAL DEVICE

CROSS-REFERENCE TO RELATED APPLICATIONS

Domestic priority is claimed on U.S. Provisional Patent Applications No. 61/230,203, filed on Jul. 31, 2009, No. 61/239,867, filed on Sep. 4, 2009, and No. 61/311,490, filed on Mar. 8, 2010, the entireties of which are incorporated herein by reference.

FIELD OF THE APPLICATION

The present application relates to a waste disposal device and, more particularly but not exclusively, to a waste disposal device for the disposal of odorous waste, such as diapers.

BACKGROUND OF THE ART

Waste disposal devices having odor-concealing systems are well known. Such waste disposal devices typically comprise a bag that is closed off by given mechanisms, to conceal the odors within the bag. U.S. Pat. No. 6,817,164 (Mauffette et al.) and U.S. Pat. No. 7,406,814 (Morand) propose such odor-concealing systems. However, it is desired to provide a waste disposal device that is simple in construction, and that may have the option of being opened by a pedal.

SUMMARY OF THE APPLICATION

It is therefore an aim of the present disclosure to provide a novel waste disposal device.

Therefore, in accordance with the present application, there is provided a waste disposal device comprising: a container having an opening at a top end, the container defining an inner cavity accessible through the opening, for receiving a bag opened at the opening of the container and having a closed end in the inner cavity; a lid pivotable to close/open access to the opening; and an actuation mechanism having an interface actuated by a user, the actuation mechanism comprising a linkage connected to the interface to open/close the lid, and a single pair of jaws connected to the linkage to move between a clamped position in which the jaws close off a portion of the bag passing therebetween, and an opened position in which the jaws are separated to allow waste to reach the closed end of the bag under the pair of jaws, the jaws and the lid being concurrently actuated by a single degree of actuation on the interface, by which the lid moves from opened to closed while the jaws move from the clamped position to the opened position and back to the clamped position.

Further in accordance with the present application, there is provided a method for the disposal of a waste object in a waste disposal device comprising a container with an opening at a top end closed by a lid, a bag opened at the opening and having a closed end positioned inside the container, jaws closing off a portion of the bag passing therebetween, and a pedal mechanism for opening/closing the lid and actuating at least one of the jaws, the method comprising: opening the lid as a result of a pressure applied on the pedal; receiving a waste object in the bag on top of the jaws; closing the lid as a result of a release of the pressure applied on the pedal; separating the jaws for the waste object to fall under the jaws in the closed end of the bag during the release of the pressure; and bringing the jaws against one another with the bag therebetween and the waste object captive in the closed end of the bag below the jaws during the release of the pressure.

BRIEF DESCRIPTION OF THE DRAWINGS

FIGS. 3A-3C are side views of the actuation mechanism and lid assembly of FIGS. 2A-2C;

DESCRIPTION OF THE PREFERRED EMBODIMENTS

Figure 1:
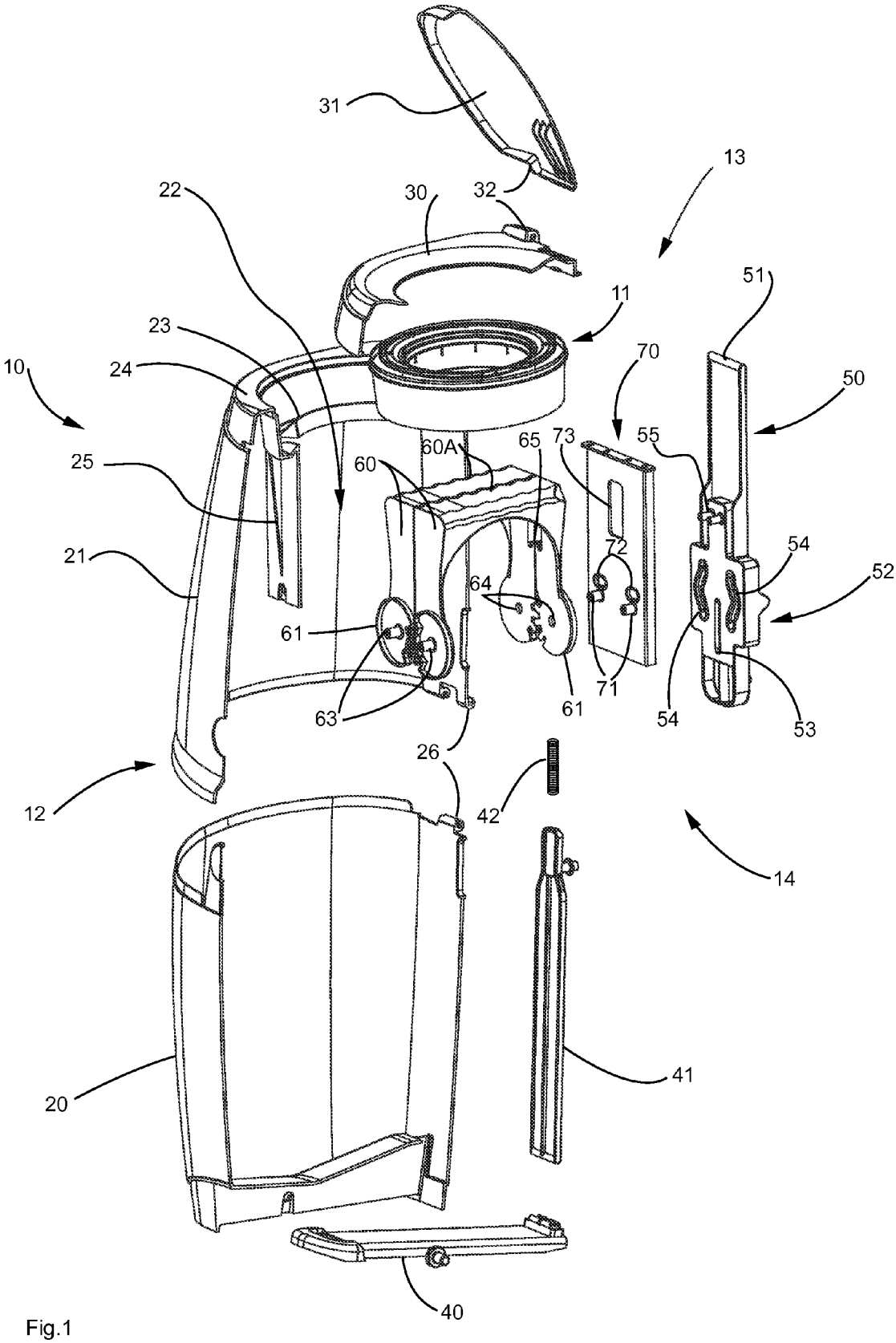
FIG. 1 is an exploded perspective view, partly sectioned, of a waste disposal device constructed in accordance with an embodiment of the present disclosure.

Referring to the drawings and more particularly to FIG. 1, a waste disposal device (hereinafter "device") is generally shown at 10. The device 10 is of the type using a cassette 11 dispensing a tubular bag, in the manner described in U.S. Pat. No. 6,974,029, by Morand et al., amongst other possibilities. Any other suitable type of bag dispenser may be used as well with the device 10. The device 10 has a container 12, a lid assembly 13 and an actuation mechanism 14.

The container 12 forms the structure of the device 10, and accommodates and conceals the tubular bag containing waste. The container 12 is not limited to the shape illustrated in the Figs. Any suitable geometry is considered as well.

The lid assembly 13 opens and closes a top opening of the container 12, through which the waste is thrown into the bag of the device 10.

The actuation mechanism 14 is manually actuated to open and close the lid assembly 13, and to move a pair of jaws that close off the bag to seal odors therein. The jaws may be arranged to have the bag closed when the lid of the lid assembly 13 is opened.

Referring to FIG. 1, the container 12 may have a base portion 20 and a top portion 21, that are separable to provide access to an interior of the container 12 for emptying the device 10. The container 12 may also be a single tubular unit. An opening 22 is at a top of the container 12. The opening 22 provides access to an interior of the container 12, for the disposal of waste in the bag.

A shoulder 23 inside the container 12 defines a seat for the cassette 11, in such a way that the tubular bag projects into an inner cavity of the container 12. According to an embodiment, the seat 23 has a specific geometry, requiring the cassette 11 to be inserted in the proper orientation. Any other suitable configuration may be used to support the cassette 11. For instance, the cassette 11 may have its own shoulder to be self-supported on a periphery of the opening 22.

An upper annular rim 24 bounds the opening 22, and is the interface between the lid assembly 13 and the container 12. Support arm 25 may be provided to project from a top of the container 12 (e.g., from a bottom of the seat 23 or rim 24) into the inner cavity of the container 12, and supports components of the actuation mechanism 14, as is described hereinafter.

Complementary hinge portions 26 are positioned on a rear side of the base portion 20 and top portion 21 of the container 12, so as to allow pivoting motion of the top portion 21 with respect to the base portion 20 for accessing an interior of the container 12.

Still referring to FIG. 1, the lid assembly 13 has an annular base 30. The geometry of the annular base 30 is complementary to that of the upper annular rim 24. Accordingly, the annular base 30 of the lid assembly 13 is seated on the annular rim 24 of the container 12. Other interconnection arrangements are considered as well, such as a press-fit, quick connect system, threading engagement, or the like.

Figures 2A, 2B, 2C:
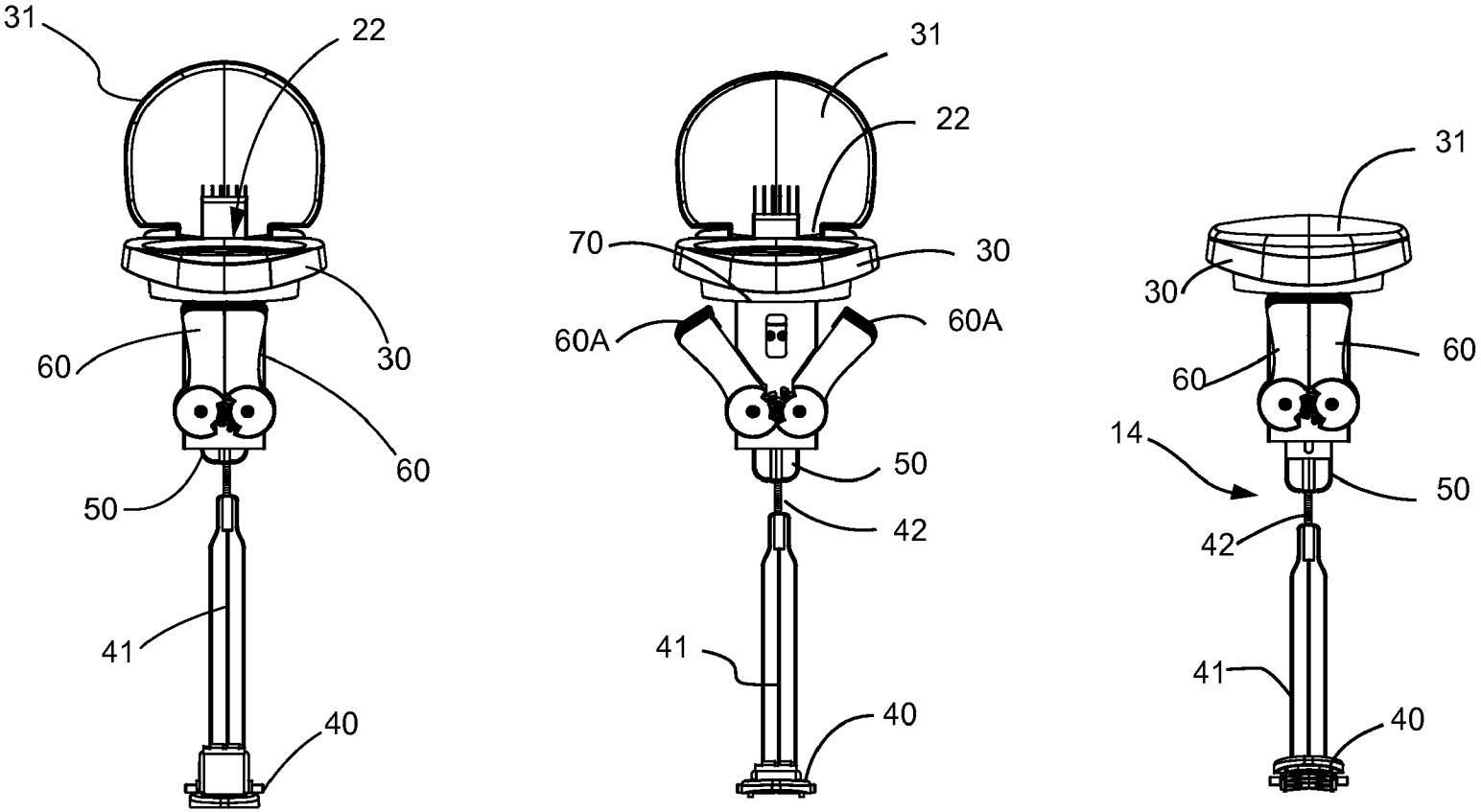
FIGS. 2A-2C are front views of an actuation mechanism and lid assembly of the waste disposal device of FIG. 1, in a lid-closing sequence.

A lid 31 is pivotally connected to the annular base 30 by hinge 32. Therefore, the lid 31 may pivot between an opened position, as shown in FIGS. 2A and 3A, and a closed position, as shown in FIGS. 2C and 3C. In the closed position, the lid 31 blocks the opening 22. In the opened position, the opening 22 is exposed, whereby a user may throw waste into the bag in the device 10.

The actuation mechanism 14 consists of linkages (i.e., links and joints) interfaced by a user with a pedal 40. The pedal 40 is pivotally connected to the base portion 20 of the container 12. A front portion of the pedal 40 projects outwardly from a front side of the container 12, and is close to the ground, whereby a user may simply press on the exposed portion of the pedal 40. The device 10 may be provided with alternative interfaces, like a hand lever or the like.

A first link 41 is connected to a rear portion of the pedal 40, inside the container 12. A joint 42 interconnects the first link 41 to a second link 50, and transmits forces from one to another. The links 41 and 50 may be connected to structural components in the container 12, so as to be restricted to translational movement (i.e., up and down). Accordingly, by pressing downwardly on the front portion of the pedal 40, the links 41 and 50 move upwardly. The subsequent release of the pedal 40 causes the links 41 and 50 to move downwardly.

Figure 4:
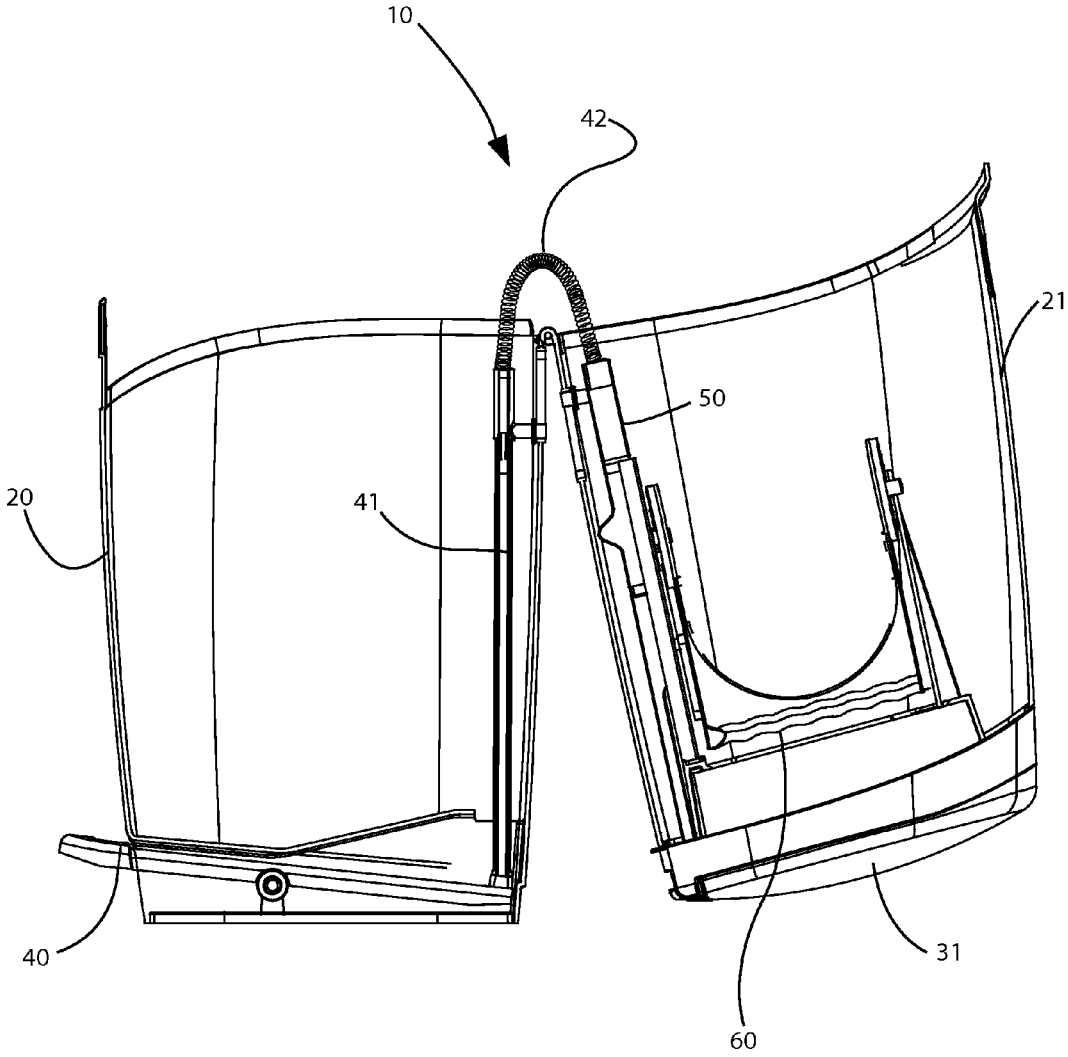
FIG. 4 is a side elevation view, partly sectioned, of the waste disposal device of FIG. 1, as opened for maintenance.

Referring to FIG. 4, the joint 42 may be a coil spring. The coil spring allows the relative movement of the links 41 and 50 with respect to one another when the container 12 is opened to access its inner cavity, by deforming. Other types of joints may be used between the links 41 and 50, if the container 12 is openable as shown in FIG. 4. If the container 12 is not openable, a single link may be used as opposed to a pair of the links 41 and 50 and joint 42.

Referring to FIG. 1, the second link 50 has a lid-pushing end 51. The lid-pushing end 51 contacts the lid 31 adjacent to the hinge 32. Accordingly, an upward movement of the second link 50 results in the opening of the lid 31 by the pushing action of the end 51 on the lid 31. Similarly, a downward movement of the second link 50 causes the movement of the lid 31 toward the closed position, by the retracting movement of the end 51.

In addition to transmitting motion of the pedal 40 to the lid 31, the second link 50 actuates jaws that seal the bag closed. The second link 50 has a jaw-opening interface 52 (FIG. 1) that is operatively connected to jaws, as described below, to convert the translational movement of the second link 50 to clamping motion of jaws (i.e., reciprocating opening and closing motion of the jaws). The jaw-opening interface 52 may have a straight slot 53, guiding slots 54 and blocking pins 55.

The actuation mechanism 14 further comprises a pair of jaws 60. Each jaw 60 has a generally horizontal bar 60A, with the bars 60A of the jaws 60 being normally one against the other in a clamping position, as shown in FIGS. 2A and 2C, to press shut the bag passing therebetween. The bars 60A may be separated from one another in an opened position, as shown in FIG. 2B, for the bag to swallow waste, i.e., allow the waste to fall to the bottom of the bag, below the jaws 60. As shown in FIG. 1, the bars 60A may have a wavy pattern to increase a contact surface between the bars 60A and the bag, and to avoid having straight edges in case of manual contact with the bars 60. Other patterns, including a straight pattern, may be used as well.

The jaws 60 each have a pair of pivot heads 61. The pivot heads 61 are generally circular in shape, and may have teeth 63 on their periphery. The teeth 63 are sized to mesh with the teeth 63 of the adjacent pivot head 61. The intermeshed teeth 63 ensure the concurrent motion of the jaws 60, between and to the positions illustrated in FIGS. 2A-2C.

On a side of the jaws 60, pivots 63 project so as to connect with the support arm 25, as best shown in FIG. 1. Alternatively, the pivots could be on the support arm 25, with corresponding holes in the jaws. On the opposite side of the jaws 60, pivot holes 64 are provided to receive a pivot, although the jaws 60 could also have pivots. Accordingly, the jaws 60 are in pivoting engagement with the container 12, to effect the closing/opening motion represented by the positions of FIGS. 2A-2C.

Figure 5:
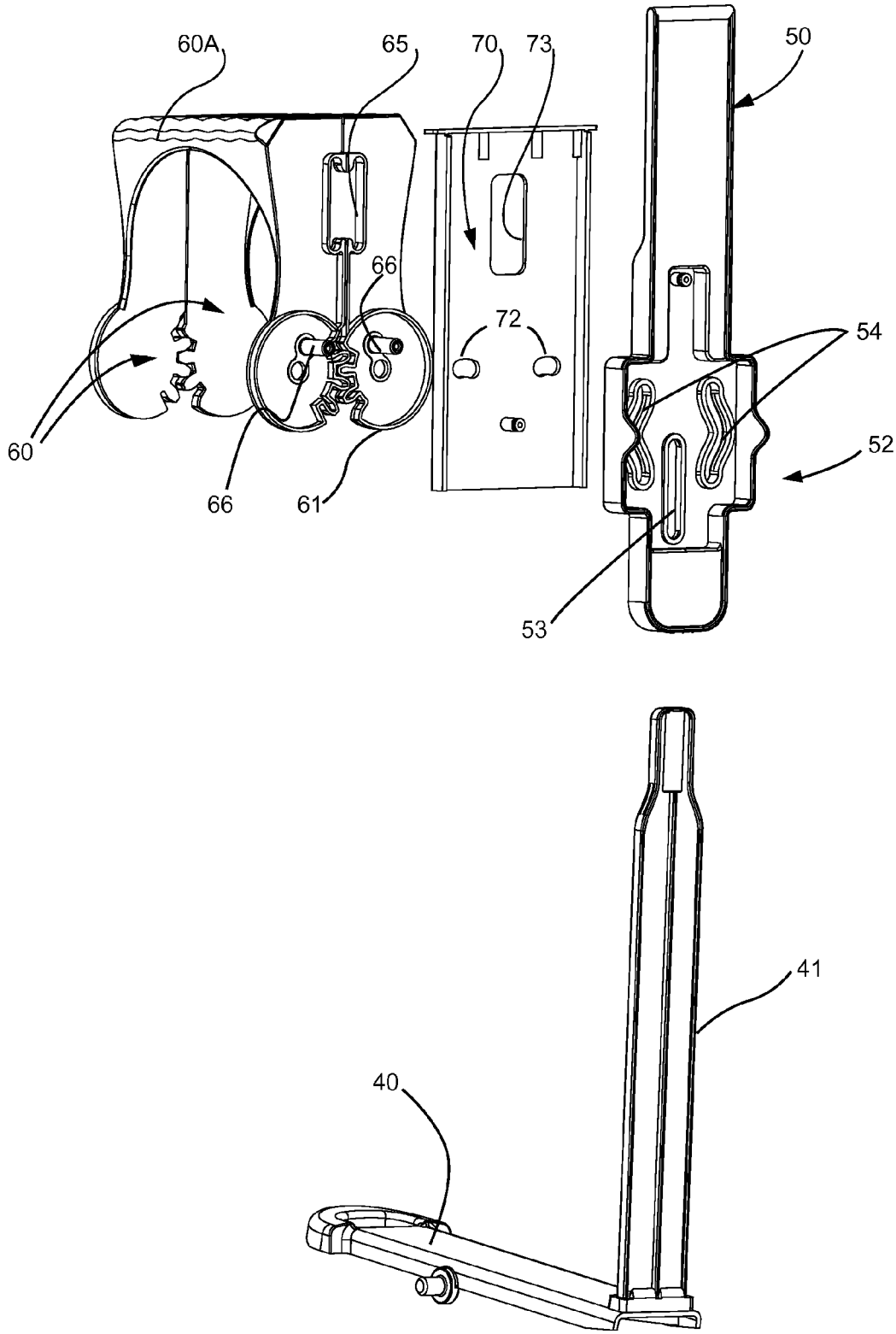
FIG. 5 is an exploded perspective view of parts of the actuation mechanism of the waste disposal device of FIG. 1.

Referring to FIGS. 1 and 5, seating slots 65 may be defined in the jaws adjacent to the bars 60, and receive the blocking pins 55 of the second link 50. The blocking pins 55 and seating slots 65 are used concurrently to ensure the jaws are clamped to one another to close off a bag that is between the jaws 60. More specifically, for the position of the second link 50 corresponding to the lid 31 being in the closed position and to the jaws 60 being clamped (FIGS. 2C and 3C), the blocking pins 55 are seated in the bottom of the seating slots 65, thereby providing additional leveraging to the clamping of the jaws 60. As an alternative, the blocking pins 55 may be part of the jaws 60, with the seating slots 65 being in the second link 50.

Referring to FIG. 5, the side of the jaws 60 hidden in FIG. 1 is shown. A pair of follower pins 66 are integral with the jaws 60 and are positioned above the pivot holes 64. The follower pins 66 are received inside the guiding slots 54 of the second link 50. The movement of the jaws 60 is a result of the follower pins 66 moving inside the guiding slots 54.

The jaws 60 may have configurations other than those described above. For instance, the jaws 60 may be mounted to the container 12 so as to translate, as opposed to rotate. In such a case, the jaws 60 would be supported by rails, and biased toward one another. Moreover, pivots, pivot holes, may be integral with the jaws 60, or separated therefrom. It is also considered to have a single one of the jaws 60 move to perform the clamping motion with the other jaw 60 being fixed. Although the embodiments described herein refer to a pair of jaws 60, a single movable jaw 60 may abut against a structural surface of the container or against any other part of the device 10. However, this structural surface is referred to as a jaw throughout the description and in the claims.

Referring to FIG. 1, a second support arm 70, also referred to as a support arm, is positioned between the second link 50 and the jaws 60. The support arm 70 is secured to the container 12, and serves as a support for at least one side of the jaws 60. There may be two of the support arms 70 in the device 10. The support arm 70 has a pair of pivots 71 that are received in the pivot holes 64 of the jaws 60, thereby allowing the pivoting motion of the jaws 60 with respect to the support arm 70. Therefore, the support arm 70 supports the jaws 60 by way of the pivots 71.

Guide clearance slots 72 are positioned above the pivots 71 to allow the interaction between the guiding slots 54 and the follower pins 66, as described above. The follower pins 66 thread through the guide clearance slots 72 to be received in the guiding slots 54 of the second link 50. The guide clearance slots 72 are wide enough to allow the lateral movement of the follower pins 66, as caused by the follower pins 66 following the movement of the guiding slots 54.

Pin clearance slot 73 is defined in the support arm 70, to allow the interaction between the blocking pins 55 and the seating slots 65, as described above. The follower pins 66 thread through the guide clearance slots 72 to be received in the guiding slots 54 of the second link 50. The length of the pin clearance slot 73 is determined as a function of the course of the blocking pins 55 defined by the translational movement of the second link 50, as actuated by the pedal 40.

Figure 6:
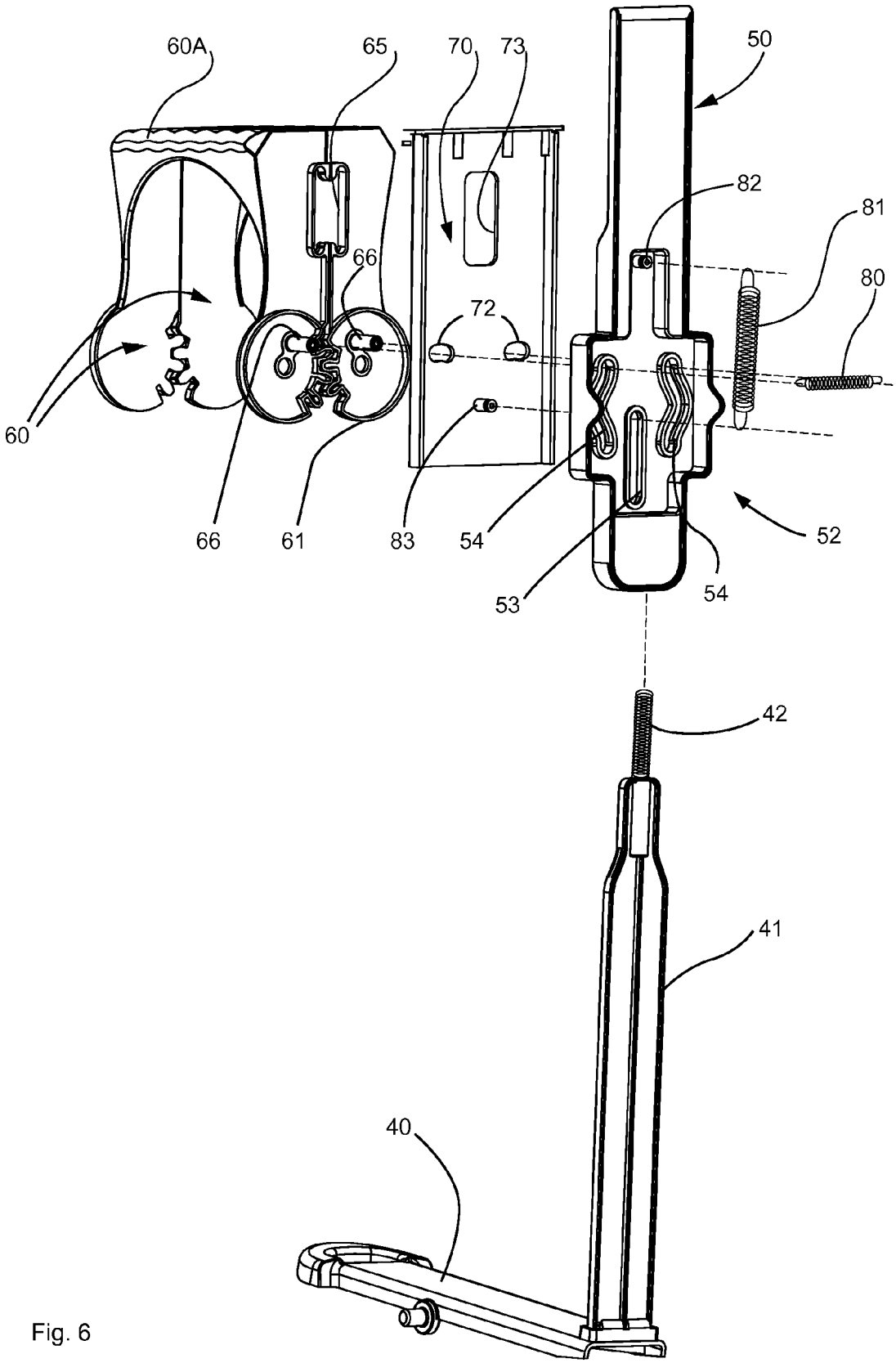
FIG. 6 is an exploded perspective view of parts of the actuation mechanism of the waste disposal device of FIG. 5, with additional components.
Figure 7:
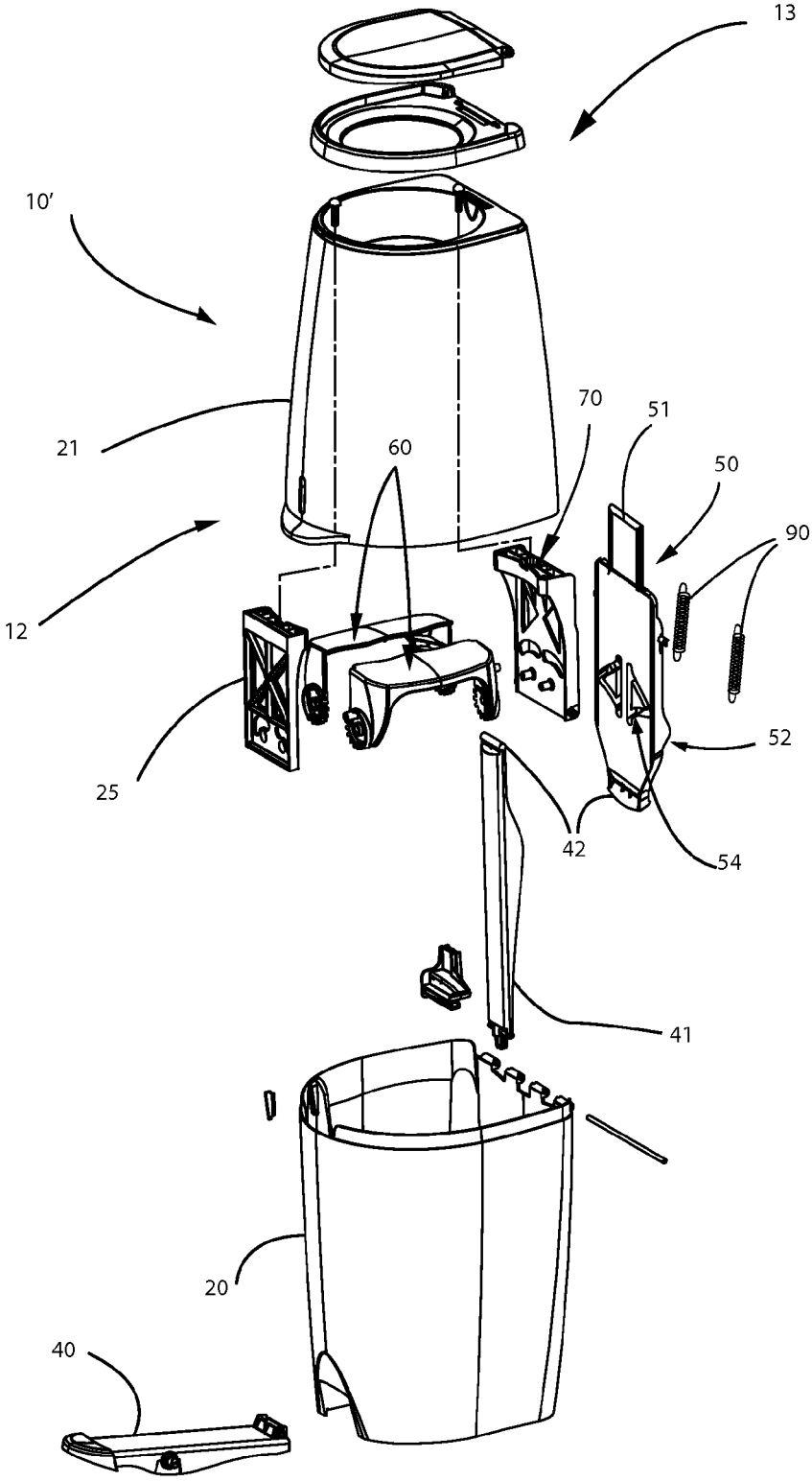
FIG. 7 is an exploded perspective view of a waste disposal device constructed in accordance with another embodiment of the present disclosure.
Figure 8:
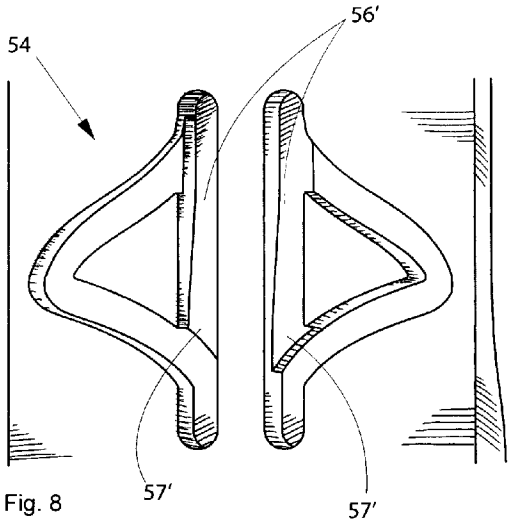
FIG. 8 is a perspective view of guiding slots of a second link of the waste disposal device of FIG. 7.

Referring to FIG. 6, there is illustrated the device from the same standpoint as FIG. 5, but with additional components. A spring 80 is positioned in a cavity of the jaw-opening interface 52, on a side opposite that of the support arm 70. Opposed ends of the spring 80 are respectively connected to one of the follower pins 66 that project through the guiding slots 54, into the cavity of the jaw-opening interface 52. The spring 80 biases the follower pins 66 toward one another, and hence the jaws 60 against each other. Accordingly, the spring 80 ensures that the jaws 60 come together after being separated by the guiding slots 54, and thus that the bag is sealed shut by the pressing action of the jaws 60. It is considered to provide another such spring on the other side of the jaws 60 (i.e., away from the second link 50), as an alternative or a complement to the spring 80.

Another spring 81 is also positioned in the cavity of the jaw-opening interface 52. Opposed ends of the spring 81 are respectively connected to a post 82 in the interface 52 and a post 83 in the support arm 70. The post 83 in the support arm 70 projects through the straight slot 53, into the cavity of the jaw-opening interface 52. The spring 81 biases the posts 82 and 83 toward one another, thereby pulling the second link 50 downwardly. The spring 81 therefore helps in closing the lid 31 of the device 10 (with the work of gravity as described hereinafter), and in maintaining the lid 31 shut, with the second link 50 pulled all the way down such that the blocking pins 55 are in a resting position in a bottom of the seating slots 65, with each bottom forming an obround end to ensure the jaws 60 are against one another.

Referring concurrently to FIGS. 7 to 10, there is shown a device 10' similar to that of FIGS. 1 to 6, whereby like elements will bear like reference numerals. The device 10' differs from the device 10 in that the joint 42 is a pivot joint, allowing a pivoting movement of the links 41 and 50 with respect to one another when the container 12 is opened to access its inner cavity.

The device 10' also differs from the device 10 in that the second link 50 of the device 10' has a by-pass mechanism in additional straight slot portions 56' in the guiding slots 54. According to one embodiment, the by-pass mechanisms comprise a blocking unit such as ramps 57' positioned in the straight slot portions 56'. Other blocking units may be used for the by-pass mechanisms as alternatives to the ramps 57', such as pivoting mechanisms or the like.

Figure 10:
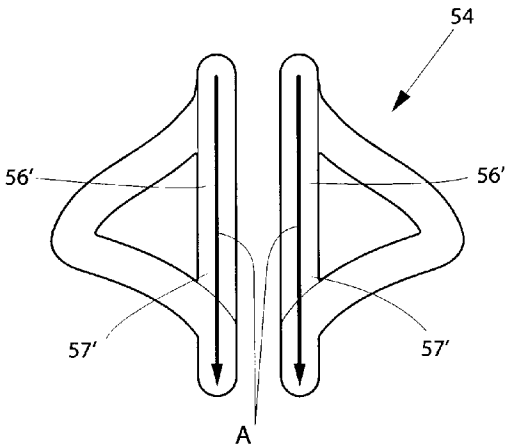
FIG. 10 is a schematic view of the second link of FIG. 8, illustrating upward movement thereof with respect to follower pins.
Figure 9:
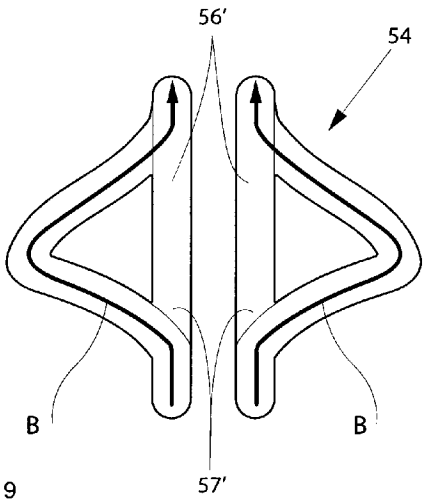
FIG. 9 is a schematic view of the second link of FIG. 8, illustrating downward movement thereof with respect to follower pins.

Initially, the follower pins 66 (FIG. 5) are in a top end of the guiding slots 54. During the opening action of the lid 31, the second link 50 moves upward with respect to the follower pins 66, whereby the follower pins 66 move along the straight slot portions 56' along direction A (FIG. 10). The follower pins 66 slide above the ramps 57', resulting in the temporary deformation of the second link 50 (or any other component) to allow the follower pins 66 to reach a bottom of the guiding slots 54. For the temporary deformation, the second link 50 may consist of a material with elastic resilience, to deform and then regain its original shape.

When the pedal 40 is released, the second link 50 moves downwardly with respect to the follower pins 66. The ends of the ramps 57' will prevent the follower pins 66 from entering the straight slot portions 56'. Rather, the follower pins 66 reach the outward bend in the guiding slots 54, as shown by B in FIG. 9. As a result, the jaws 60 only open for the downward movement of the second link 50, i.e., when the lid 31 closes, according to the sequence of FIGS. 2A to 2C.

Additionally, springs 90 may be used to bias the second link 50 to its downward position, in the normal closed state of the device 10'. The springs 90 may interconnect the second link 50 to the container 12, or may be positioned at any other suitable location in the device 10' to bias the second link 50 downwardly.

Now that the components of the devices 10 and 10' have been detailed, a sequence of operation of the devices 10 and 10' is described.

Referring to FIGS. 2A and 3A, the device 10/10' is in a normal opened state by a pressing action on the pedal 40, with the pedal 40 pressed fully to its bottom position. The container 12 is not illustrated in FIGS. 2A-3C for simplicity purposes. The lid 31 is opened allowing access to an interior of the container 12, and thus to a bag (not shown). It is observed that the jaws 60 are clamped to one another at that point, by the follower pins 66 (FIG. 5) having left the outward bend and reached the straight bottom of the guiding slots 54 of the second link 50. The bag passes through the jaws 60 and is thus closed off by the bars 60A of the jaws 60 contacting one another. Accordingly, if waste is already present in a bottom of the bag, any odor emanating from the bag is concealed in the bag by the action of the jaws 60.

Referring to FIGS. 1, 2B and 3B, pressure is released from the pedal 40. The released of pressure on the pedal 40 is converted to a downward translational movement of the second link 50, whereby the lid 31 moves toward a fully closed position by the action of the lid pressing end 51. During the downward movement of the second link 50, the follower pins 66 (FIG. 5) reach the outward bend in the guiding slots 54 (FIG. 1). This results in the jaws 60 separating from one another, as illustrated in FIG. 2B, whereby any disposed object above the jaws 60 is swallowed by falling below the level of the bars 60A of the jaws 60.

Referring to FIGS. 2C and 3C, there is no more pressure on the pedal 40. The lid 31 is in the closed position, closing an access to an interior of the container 12. It is observed that the jaws 60 are clamped to one another at that point, by the follower pins 66 (FIG. 5) having left the outward bend and reached the top of the guiding slots 54 of the second link 50. As a result, the bag is shut closed by the jaws 60. This minimizes the emanation of waste odors from the device 10/10'. The closing sequence is helped with the action of gravity on the lid 31 and the links 41 and 50, and optionally with the additional forces provided by the spring 81.

It is pointed out that the guiding slots 54 may be positioned in the second link 50 in such a way that the clamping motion of the jaws 60 occurs when the lid 31 is almost closed, or even closed. In another embodiment, the clamping motion of the jaws 60 occurs when the lid 31 is still at least partially open, such that the lid 31 stays open if a waste object is caught between the jaws 60, for instance because the bag is full.

When pressure is applied on the pedal 40, the opening sequence of the lid 31 is the reverse of the closing sequence, and therefore is illustrated by FIGS. 2A, 2B and 2C, in the respective order, for the device 10. The device 10' (FIGS. 7 to 10) does not allow the jaws 60 to open in the opening sequence of the lid 31.

It is pointed out that the opening sequence of the lid (FIGS. 2A-2C), and the closing sequence of the lid (FIGS. 2C-2A) are both performed rapidly (i.e., in seconds or fractions of seconds). Accordingly, the jaws 60 are separated from one another for a very brief moment during the two opening/closing sequences. As a result, the jaws 60 are clamped most of the time, to limit the escape of waste odors from the device 10. It is observed that the lid 31 and jaws 60 are actuated concurrently by a single degree of actuation on the pedal 40 to press the lid 31 opened, and a single degree of actuation releasing pressure on the pedal 40.

The invention claimed is:

1. A waste disposal device comprising:

a container having an opening at a top end, the container defining an inner cavity accessible through the opening, for receiving a bag opened at the opening of the container and having a closed end in the inner cavity;

a lid pivotable to close/open access to the opening; and an actuation mechanism having an interface actuated by a user, the actuation mechanism comprising a linkage connected to the interface to open/close the lid, and a single pair of jaws connected to the linkage to move between a clamped position in which the jaws close off a portion of the bag passing therebetween, and an opened position in which the jaws are separated to allow waste to reach the closed end of the bag under the pair of jaws, the jaws and the lid being concurrently actuated by a single degree of actuation on the interface, by which the lid moves from opened to closed while the jaws move from the clamped position to the opened position and back to the clamped position.

2. The waste disposal device according to claim 1, wherein the interface is a pedal, and the single degree of actuation is a release of pressure on the pedal.

3. The waste disposal device according to claim 1, wherein the linkage has a portion translating in a generally vertical direction in the inner cavity, the linkage having a top pushing end contacting the lid to displace the lid to open access to the opening.

4. The waste disposal device according to claim 3, wherein the jaws are pivotally connected to a structure in the inner cavity of the container, and wherein a set of pins and guide slots is provided between the jaws and the linkage for the jaws to move between the clamped position and the opened position as a function of a translation of the linkage in the generally vertical direction.

5. The waste disposal device according to claim 4, wherein the guide slots each have straight portions with a bent portion therebetween, the jaws moving from the clamped position, to the opened position and back to the clamped position when each of the pins moves sequentially from one of the straight portions, to the bent portion, and to the other one of the straight portions.

6. The waste disposal device according to claim 4, wherein the guide slots each have a straight portion with a blocking unit therein, and a bent portion joined in parallel relation with the straight portion, the jaws moving from the clamped position, to the opened position and back to the clamped position when the pins each move into a corresponding one of the bent portion as a function of the single degree of actuation closing the lid, the jaws remaining in the clamped position when the pins move in the straight portion and by the blocking unit as a function of the single degree of actuation opening the lid, the pin being directed to the bent portion by the blocking unit.

7. The waste disposal device according to claim 6, wherein the blocking unit is a ramp in the straight portion with the pin passing over the ramp when the single degree of actuation opens the lid, the ramp directing the pin to the bent portion when the single degree of actuation closes the lid.

8. The waste disposal device according to claim 4, wherein the pins are integral with the jaws, and the guide slots are in the linkage.

9. The waste disposal device according to claim 4, further comprising a support arm connected to an interior of the container, and pivotally supporting at least one side of the jaws, the support arm being sandwiched between the jaws and the linkage and defining an opening for the operative connection between the pins and guide slots.

10. The waste disposal device according to claim 4, comprising meshing on a periphery of the jaws, whereby the jaws are intermeshed for concurrent rotation between the clamped position and the opened position.

11. The waste disposal device according to claim 4, further comprising a set of pins and seating slots provided between the jaws and the linkage, the pins received in the seating slots when the lid is closed and the jaws are in the clamped position to lock the jaws against one another with the bag passing therebetween.

12. The waste disposal device according to claim 4, further comprising a biasing unit biasing the jaws toward one another.

13. The waste disposal device according to claim 1, further comprising at least one biasing unit biasing the linkage to a downwardmost position to keep the jaws in the clamped position.

14. The waste disposal device according to claim 1, wherein the jaws have a wavy surface at an area of contact therebetween.

15. The waste disposal device according to claim 1, wherein the container comprises a top portion and a base portion, the top portion being pivotally connected to the base portion for access to the inner cavity of the container.

16. The waste disposal device according to claim 15, wherein the linkage comprises a first link member connected to the interface by a joint, and a second link member connected to a free end of the first link member by an other joint, the other joint allowing relative movement of the link members when the top portion is pivoted open with respect to the base portion.

17. A method for the disposal of a waste object in a waste disposal device comprising a container with an opening at a top end closed by a lid, a bag opened at the opening and having a closed end positioned inside the container, jaws closing off a portion of the bag passing therebetween, and a pedal mechanism for opening/closing the lid and actuating at least one of the jaws, the method comprising:

opening the lid as a result of a pressure applied on the pedal;

receiving a waste object in the bag on top of the jaws;

closing the lid as a result of a release of the pressure applied on the pedal;

separating the jaws for the waste object to fall under the jaws in the closed end of the bag during the release of the pressure; and bringing the jaws against one another with the bag therebetween and the waste object captive in the closed end of the bag below the jaws during the release of the pressure.

18. The method according to claim 17, wherein opening the lid comprises keeping the jaws against one another continuously while pressure is applied on the pedal.

19. The method according to claim 17, wherein separating the jaws and subsequently bringing the jaws against one another occur once the lid as reached a closed position.

* * * * *